US006352597B1

(12) United States Patent
Gutfleisch et al.

(10) Patent No.: US 6,352,597 B1
(45) Date of Patent: Mar. 5, 2002

(54) METHOD FOR PRODUCING A MAGNETIC ALLOY POWDER

(75) Inventors: Oliver Gutfleisch; Michael Kubis; Axel Handstein, all of Dresden; Bernhard Gebel, Coswig; Karl-Hartmut Mueller, Dresden, all of (DE); Ivor Harris, Birmingham (GB); Ludwig Schultz, Pappritz (DE)

(73) Assignee: Institut fuer Festkoerper- und Werkstofforschung Dresden e.V., Dresden (DE)

( * ) Notice: Subject to any disclaimer, the term of this patent is extended or adjusted under 35 U.S.C. 154(b) by 0 days.

(21) Appl. No.: 09/554,841

(22) PCT Filed: Nov. 19, 1998

(86) PCT No.: PCT/EP98/07418

§ 371 Date: Jul. 14, 2000

§ 102(e) Date: Jul. 14, 2000

(87) PCT Pub. No.: WO99/27544

PCT Pub. Date: Jun. 3, 1999

(30) Foreign Application Priority Data

Nov. 20, 1997 (DE) ..... 197 51 367
Nov. 20, 1997 (DE) ..... 197 51 366

(51) Int. Cl.[7] ..... H01F 1/06
(52) U.S. Cl. ..... 148/101; 148/105; 75/348
(58) Field of Search ..... 148/101, 105; 75/348

(56) References Cited

U.S. PATENT DOCUMENTS 5,143,560 A * 9/1992 Doser ..... 148/105
5,474,623 A * 12/1995 Ma et al. ..... 148/105
5,851,312 A * 12/1998 Honkura et al. ..... 148/105
6,056,830 A * 5/2000 Honkura et al. ..... 148/101

FOREIGN PATENT DOCUMENTS

FR 2387500 * 11/1978

OTHER PUBLICATIONS

Kianvash, A., et al., "Hydrogen decrepitation as a method of powder preparation of a 2:17–type, Sm(Co,Cu,Fe,Zr)8.92 magnetic alloy", *Journal of Materials Science*, vol. 20, No. 2, Feb. 1985, pp. 682–688.*

Kwon, H.W., et al., "Study of Sm(Co,Fe,Cu,Zr)7.1 magnets produced using a combination of hydrogen decrepitation and ball milling", *Journal of Applied Physics*, vol. 69, No. 8, Part IIB, Apr. 1991, pp. 5856–5858.*

* cited by examiner

*Primary Examiner*—George Wyszomierski
(74) *Attorney, Agent, or Firm*—Reed Smith LLP

(57) ABSTRACT

A method is disclosed enabling a technologically controllable and economical production of a hard-magnetic powder composed of a samarium-cobalt base alloy for highly coercive permanent magnets. The method is based on a HDDR treatment in which a starting powder is subjected to hydrogenation with disproportionation of the alloy in a first method step under hydrogen and, in a subsequent, second method step under vacuum conditions, a hydrogen desorption with recombination of the alloy. A starting powder containing samarium and cobalt is treated in the first method step either at a high temperature in the range of 500° C. to 900° C. and with a high hydrogen pressure of >0.5 MPa or by applying an intensive fine grinding at a low temperature in the range of 50° C. to 500° C. and with a hydrogen pressure of >0.15 MPa. By means of the method of the invention, magnetic alloy powders can be produced from samarium-cobalt base alloys; highly coercive permanent magnets can be produced from these magnetic alloy powders, particularly by hot compacting or plastic bonding.

8 Claims, No Drawings

METHOD FOR PRODUCING A MAGNETIC ALLOY POWDER

BACKGROUND OF THE INVENTION

1. Field of the Invention

The invention relates to the field of metallurgic process technology and is directed to a method for producing a magnetic alloy powder for hard-magnetic applications. The powder is formed of a samarium-cobalt base alloy. The powder can be used to produce highly coercive permanent magnets by means of hot compacting or plastic bonding. However, permanent magnets of this type can also be generated with the powder through powder metallurgy by means of sintering.

2. Description of the Related Art

Permanent magnets based on Sm—Co were formerly produced predominantly through powder metallurgy by sintering (K. Strnat and R. M. W. Strnat, *J. Magn. Magn. Mater.* 100 (1991) 38). To produce the Sm—Co powder needed for this, it is already known first to melt a corresponding alloy, to comminute this alloy after solidification, and to subject it to heat treatment in a passivation gas below the phase transformation temperature of the alloy (U.S. Pat. No. 5,122,203). A production method of this kind has the disadvantage that an energy-consuming and time-consuming multiple-stage heat treatment is needed to adjust high coercive field strengths. Further, a production method of this kind has the disadvantage that additives such as Cu and Zr are needed for $Sm_2Co_{17}$-type magnets in order to adjust the microstructure which enables a high coercive field strength by means of the pinning process. However, these additives reduce the saturation magnetization.

The HD process (hydride decrepitation) has long been known (U.S. Pat. No. 5,580,396, column 8, lines 30 to 41; Rare-earth Iron Permanent Magnets, ed. J. M. D. Coey, Oxford 1996, pages 346 to 349 and pages 370 to 380) in the field of magnetic powder production based on alloys with elements from the group of rare earths (RE). This process is used for the comminution of coarse, compact alloy bodies and is accordingly used to generate powders. In this connection, use is made of the effect whereby the hydrogen diffused in the intermediate grain phase or on the interstitial lattice sites of the RE compound leads to an expansion or lattice elongation of the RE compound. The tensions brought about by the expansion or lattice elongation lead to intergranular crack formation and, ultimately, to an actual bursting or pulverizing (decrepitation) of the hydrogenated material. This pulverization process can also be reinforced by the effect of vibrations (DE 28 16 538) or by the use of a swing mill (CH 560 955).

When applying the HD process for a bond $A_x B_y$, where A is a rare earth element and B represents one or more other elements (usually transition metals), the following reaction takes place:

$$A_xB_y+z/2H_2 \rightarrow A_xB_yH_z \qquad \text{(HD process).}$$

Often, after the actual HD process, a removal/desorption of the hydrogen takes place during the further processing of the generated powder into the end product in the course of the subsequent process steps, for example, during sintering, wherein the following reaction takes place: $A_xB_yH_z \rightarrow$H $A_xB_y$+z/2 $H_2$.

It is also already known (EP 0 304 054; EP 0 516 264; DE 196 07 747) to apply the HDDR method (hydrogenation-disproportionation-desorption-recombination) in the production of magnetic powders in particular from Nd—Fe—B alloys for improving the magnetic characteristics. In this treatment, the powder is hydrogenated in a first process step in a hydrogen atmosphere with a low pressure in the range of $0.8\times10^5$ Pa to a maximum of 0.15 MPa. As a consequence of this hydrogen treatment, a chemical reaction (disproportionation) takes place, that is, the original phase decomposes accompanied by the formation of a binary hydride and the rest of the elements or combinations of elements of the initial phase.

This chemical reaction can be shown schematically as follows (by analogous use of the above-mentioned model substance $A_xB_y$):

$$A_xB_y+z/2H_2 \rightarrow A_xH_z+yB \qquad \text{(HDDR step 1).}$$

Subsequently, in a second process step by means of a heat treatment under vacuum conditions, the hydrogenated alloying elements are dehydrogenated again accompanied by simultaneous recombination of the alloying composition decomposed in step 1 according to the following reaction equation:

$$A_xH_z+yB \rightarrow A_xB_y+z/2H_2 \qquad \text{(HDDR step 2).}$$

A crystallite size is achieved in the range of a single-domain particle size, e.g., approximately 300 nm for $Nd_2Fe_{14}B$ and $Sm_2Fe_{17}N_3$, by the HDDR treatment. This grain refining, which leads to an improvement of the magnetic properties of the magnetic powder, is the main goal of the HDDR treatment and not as—in the HD process—the production of powder. It is expressly noted in this respect that the HD process is not identical to the first step of the HDDR treatment as might possibly be suggested by the first two letters of the abbreviation "HDDR".

In the first step of the HDDR process, when heating up to the temperatures of 500° C. to 10000° C. needed for the above-mentioned reaction, the hydrogen absorption typical for the HD process, as was described above in the equation for the HD process, often comes about, but this only represents an intermediate reaction which immediately follows the desorption of the hydrogen. The HDDR treatment can be carried out in complete independence from the HD process as was shown, for example, in the "solid HDDR process" in which the hydrogen gas is first admitted to the reactor at the temperature needed for disproportionation (HDDR step 1); thus, no interstitial absorption of the hydrogen takes place and, accordingly, the HD process does not come about (Gutfleisch et al., *J. Alloys Compd.* 215 (1994) 227).

Increasing stabilization of RE-Fe compounds in the case of substitution of the Fe by Co is also known (A. Fujita and I. R. Harris, *IEEE Trans. Magn.* 30 (1994) 860).

It is not possible to transfer the HDDR process conditions known for Nd—Fe—B magnetic powder to Sm—Co magnetic powder because a disproportionation reaction such as that taking place under the usual HDDR conditions (500<T<1000° C., ~0.1 MPa hydrogen pressure) does not occur in the case of Sm—Co magnetic powder because of the great stability of these alloys.

OBJECT AND SUMMARY OF THE INVENTION

The primary object of the invention is to provide a method enabling a technologically controllable and economical production of a hard-magnetic powder composed of a samarium-cobalt base alloy for highly coercive permanent magnets.

This object is met, according to the invention, by a method enabling a technologically controllable and economical production of a hard-magnetic powder composed of a samarium-cobalt base alloy for highly coercive permanent magnets. The method is based on a HDDR treatment in which a starting powder is subjected to hydrogenation with disproportionation of the alloy in a first method step under hydrogen and, in a subsequent, second method step under vacuum conditions, a hydrogen desorption with recombination of the alloy. A starting powder containing samarium and cobalt is treated in the first method step either at a high temperature in the range of 500° C. to 900° C. and with a high hydrogen pressure of >0.5 MPa or by applying an intensive fine grinding at a low temperature in the range of 50° C. to 500° C. and with a hydrogen pressure of >0.15 MPa. By the method of the invention, magnetic alloy powders can be produced from samarium-cobalt base alloys; highly coercive permanent magnets can be produced from these magnetic alloy powders, particularly by hot compacting or plastic bonding.

Both variants of the method lead to the disproportionation of the initial phase and to the formation of a crystalline binary samarium hydride.

When applying the high temperature in the range of 500° C. to 900° C., a hydrogen pressure in the range of 1.0 MPa to 5.0 MPa is preferably applied.

According to an advisable configuration of the method, the intensive fine grinding is carried out for a period of 1 h to 100 h.

According to the invention, a powder of a Sm—Co base alloy or a powder mixture comprising the individual elements of a Sm—Co base alloy and/or comprising one or more precursor alloys suitable for the production of a Sm—Co base alloy can be used as a starting powder when applying intensive fine grinding.

When using intensive fine grinding, the starting powder should be ground fine preferably with hydrogen pressure in the range of 0.5 MPa to 2.5 MPa.

The hydrogen desorption treatment is advisably carried out in the obtained magnetic powder by heat treatment in the range of 500° C. to 1000° C.

According to the invention, a starting powder which leads to magnetic alloy powders with the alloy composition $Sm_xCo_{100-x}$, where 10<x<30, or the alloy composition $Sm_xCo_{100-x-a-b-c}Fe_aCu_bZr_c$, where 10<x<30, a <45, b <15 and c<15, is preferably used.

The method according to the invention provides a new possibility for magnetic hardening of Sm—Co base compounds. The method results in novel approaches for optimizing the magnetic properties of Sm—Co magnets resulting in improved properties and represents an economical alternative for the production of such magnets. This includes the possibility of homogenizing the microstructure of the Sm—Co base compounds, so that a cumbersome homogenizing at high temperatures can be dispensed with.

BEST MODES FOR CARRYING OUT THE INVENTION

The invention is described more fully in the following by embodiment examples.

EXAMPLE 1

A melted $Sm_2(Co,Fe,Cu,Zr)_{17}$ starting alloy, such as is conventionally used for the production of Sm—Co sintered magnets and whose coercive field strengths are determined by the pinning mechanism, is comminuted to particle sizes of less than 160 μm and is subsequently heated in a hydrogen atmosphere of 2 MPa to a temperature of 600° C. and is kept at this temperature for a half hour. The powder is hydrogenated by the hydrogen, wherein a disproportionation of the alloy occurs. The powder is subsequently heated up to 750° C. accompanied by continuous pumping off and is again kept at this temperature for a half hour.

The powder produced in this way has a high coercive field strength $H_c$ of approximately 5 kA/cm and can be processed to form efficient permanent magnets.

EXAMPLE 2

A $SmCo_5$ starting alloy is comminuted to particle sizes of less than 500 μm and is subsequently heated in a hydrogen atmosphere of 2 MPa to a temperature of 600° C. and is kept at this temperature for a half hour. The powder is subsequently heated up to 750° C. accompanied by continuous pumping off and is again kept at this temperature for a half hour.

The powder produced in this way has a high coercive field strength $H_c$ of approximately 10 kA/cm and can be used to produce efficient permanent magnets.

EXAMPLE 3

A melted $Sm_2(Co,Fe,Cu,Zr)_{17}$ starting alloy, such as that conventionally used for the production of Sm—Co sintered magnets and whose coercive field strengths are determined by the pinning mechanism, is comminuted to particle sizes of less than 160 μm and is subsequently intensively ground by means of a vibration mill in a hydrogen atmosphere of 1 MPa at a temperature in the grinding vessel of 350° C. for a period of 20 h. In so doing, a disproportionation of the alloy takes place simultaneously, in addition to a fine grinding, due to the presence of hydrogen. The powder is subsequently heated up to 750° C. accompanied by continuous pumping off of hydrogen for carrying out a hydrogen desorption and is kept at this temperature for a half hour.

The powder produced in this way has a high coercive field strength $H_c$ of approximately 10 kA/cm and can be processed to form efficient permanent magnets.

EXAMPLE 4

A $SmCo_5$ starting alloy is comminuted to particle sizes of less than 500 μm and is subsequently intensively ground by means of a vibration mill in a hydrogen atmosphere of 1 MPa at a temperature in the grinding vessel of 350° C. for a period of 20 h. In so doing, a disproportionation of the alloy takes place simultaneously, in addition to a fine grinding, due to the presence of hydrogen. The powder is subsequently heated up to 900° C. accompanied by the continuous pumping off of hydrogen for carrying out a hydrogen desorption and is kept at this temperature for a half hour.

The powder produced in this way has a high coercive field strength $H_c$ of approximately 30 kA/cm and can be used to produce efficient permanent magnets.

While the foregoing description and drawings represent the present invention, it will be obvious to those skilled in the art that various changes may be made therein without departing from the true spirit and scope of the present invention.

What is claimed is:

1. A method for the production of a magnetic alloy powder for hard-magnetic applications, comprising a hydrogenation-disproportionation-desorption-recombination treatment including the steps of:

subjecting a starting powder to hydrogenation with disproportionation of the alloy in a hydrogen atmosphere in a first method step; and carrying out a hydrogen desorption with recombination of the alloy in a subsequent, second method step under vacuum conditions;

said method further comprising, in the first method step, treating a starting powder containing samarium and cobalt either at a high temperature in the range of 500° C. to 900° C. and with a high hydrogen pressure of >0.5 MPa or by applying an intensive fine grinding to the starting powder grinding at a low temperature in the range of 50° C. to 500° C. and with a hydrogen pressure of >0.15 MPa.

2. The method according to claim 1, comprising applying the high temperature in the range of 500° C. to 900° C. at a hydrogen pressure in the range of 1.0 MPa to 5.0 MPa.

3. The method according to claim 1, comprising applying the intensive fine grinding for a period of 1 h to 100 h.

4. The method according to claim 1, comprising applying intensive fine grinding to a powder of a Sm—Co base alloy or a powder mixture comprising the individual elements of a Sm—Co base alloy and/or comprising one or more precursor alloys suitable for the production of a Sm—Co base alloy.

5. The method according to claim 1, comprising intensive fine grinding of the starting powder with hydrogen pressure in the range of 0.5 MPa to 2.5 MPa.

6. The method according to claim 1, wherein the hydrogen desorption treatment is carried out by heat treatment in the range of 500° C. to 1000° C.

7. The method according to claim 1, wherein a magnetic alloy powder with the alloy composition $Sm_xCo_{100-x}$, where $10<x<30$, is produced.

8. The method according to claim 1, wherein a magnetic alloy powder with the alloy composition $Sm_xCo_{100-x-a-b-c}Fe_aCu_bZr_c$, where $10<x<30$, $a<45$, $b<15$ and $c<15$, is produced.

* * * * *